US009114865B1

(12) United States Patent
Gonring

(10) Patent No.: US 9,114,865 B1
(45) Date of Patent: Aug. 25, 2015

(54) SYSTEMS AND METHODS FOR OPERATOR CONTROL OF MOVEMENTS OF MARINE VESSELS

(71) Applicant: Brunswick Corporation, Lake Forest, IL (US)

(72) Inventor: Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/249,924

(22) Filed: Apr. 10, 2014

(51) Int. Cl.
*B63H 21/21* (2006.01)

(52) U.S. Cl.
CPC ..... *B63H 21/213* (2013.01)

(58) Field of Classification Search
USPC ..... 440/1, 84, 87
IPC ..... B63H 21/213
See application file for complete search history.

(56) References Cited

U.S. PATENT DOCUMENTS

| | | | | |
|---|---|---|---|---|
| 4,769,629 | A * | 9/1988 | Tigwell | 340/467 |
| 6,234,853 | B1 | 5/2001 | Lanyi et al. | |
| 6,273,771 | B1 | 8/2001 | Buckley et al. | |
| 6,511,354 | B1 | 1/2003 | Gonring et al. | |
| 6,866,022 | B1 | 3/2005 | Phillips et al. | |
| 6,994,046 | B2 | 2/2006 | Kaji et al. | |
| RE39,032 | E | 3/2006 | Gonring et al. | |
| 7,267,068 | B2 | 9/2007 | Bradley et al. | |
| 7,305,928 | B2 | 12/2007 | Bradley et al. | |
| 7,467,595 | B1 | 12/2008 | Lanyi et al. | |
| 8,417,399 | B2 | 4/2013 | Arbuckle et al. | |
| 8,478,464 | B2 | 7/2013 | Arbuckle et al. | |
| 2008/0071424 | A1 * | 3/2008 | St. Jean et al. | 700/282 |
| 2010/0090864 | A1 * | 4/2010 | Craig | 340/908 |
| 2012/0314894 | A1 * | 12/2012 | Lund | 381/334 |

OTHER PUBLICATIONS

U.S. Appl. No. 13/221,493, filed Aug. 30, 2011.

* cited by examiner

*Primary Examiner* — Stephen Avila
(74) *Attorney, Agent, or Firm* — Andrus Intellectual Property Law, LLP

(57) ABSTRACT

Systems are for operator control of a marine vessel. The systems can include a base; a handle that is pivotable with respect to the base; a first accelerometer coupled to the handle, the first accelerometer having an output that indicates an amount of an acceleration of the handle and a direction of movement of the handle; and a second accelerometer coupled to the base, the second accelerometer having an output that indicates an amount of acceleration of the base and a direction of movement of the base. A control circuit compares the outputs of the first accelerometer and the second accelerometer to calculate an amount of movement of the handle with respect to the base and a direction of movement of the handle with respect to the base.

20 Claims, 9 Drawing Sheets

SYSTEMS AND METHODS FOR OPERATOR CONTROL OF MOVEMENTS OF MARINE VESSELS

FIELD

The present disclosure relates to systems and methods for operator control of movement of marine vessels.

BACKGROUND

U.S. Reissue Pat. No. RE39,032, which is hereby incorporated herein by reference in entirety, discloses a multipurpose control mechanism that allows an operator of a marine vessel to use the mechanism as both a standard throttle and gear selection device and, alternatively, as a multi-axis joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second and third secondary control signals relating to desired maneuvers of the marine vessel.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. patent application Ser. No. 13/221,493, which is incorporated herein by reference in entirety, discloses a device for inputting command signals to a marine vessel control system that can include a lever that is selectively operable in the joystick mode and the lever mode. In the lever mode, the lever is confined to pivoting about a horizontal axis to thereby input throttle and shift commands to the control system. In the joystick mode, the lever is freely pivotable in all directions away from a vertical axis that is perpendicular to the horizontal axis to thereby input throttle, shift, and directional commands to the control system.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure arose from the present inventors' research and development of control mechanisms and devices.

In certain examples, systems are for operator control of a marine vessel. The systems can comprise: a base; a handle that is pivotable with respect to the base; a first accelerometer coupled to the handle, the first accelerometer having an output that indicates an amount of an acceleration of the handle and a direction of movement of the handle; a second accelerometer coupled to the base, the second accelerometer having an output that indicates an amount of acceleration of the base and a direction of movement of the base; and a control circuit that compares the outputs of the first accelerometer and the second accelerometer to calculate an amount of movement of the handle with respect to the base and a direction of movement of the handle with respect to the base.

In certain examples, marine vessels are disclosed wherein the base of the system is fixed to a helm of the marine vessel.

In certain examples, methods of operator control of movement of a marine vessel are disclosed. The methods can comprise: (1) pivoting a handle with respect to a base that is fixed to the marine vessel; (2) outputting an amount of acceleration of the base and a direction of movement of the base to a control circuit; (3) outputting an amount of an acceleration of the handle and a direction of movement of the handle to the control circuit; and (4) calculating, with the control circuit, an amount of movement of the handle with respect to the base and a direction of movement of the handle with respect to the base, based upon the outputs of the first accelerometer and the second accelerometer.

BRIEF DESCRIPTION OF THE DRAWINGS

Examples of systems and methods for operator control of movements of marine vessels are described with reference to the following Figures. The same numbers are used throughout the Figures to reference like features and like components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

Figure 1:
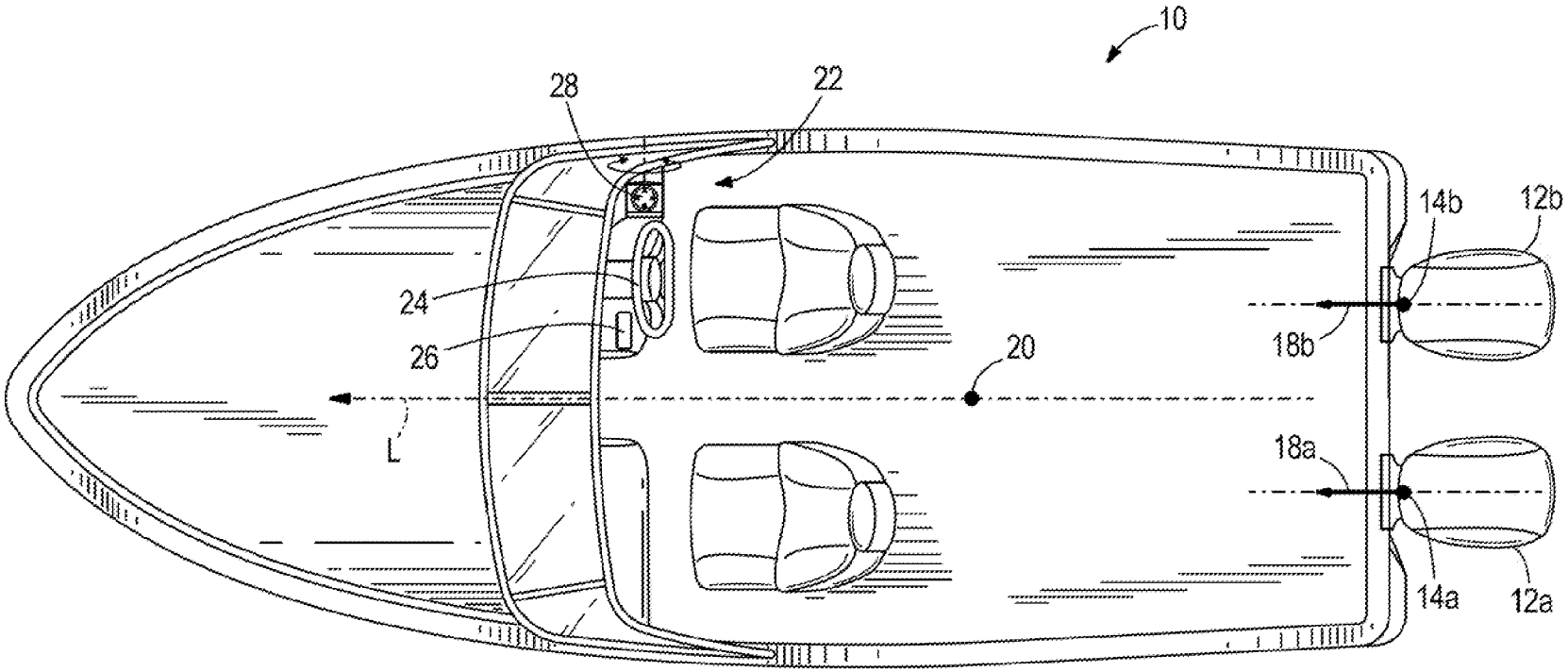
FIG. 1 is a top view of a marine vessel having a pair of marine propulsion devices in an aligned orientation.

FIG. 1 depicts a marine vessel 10 having port and starboard propulsion devices 12*a*, 12*b*, which in the example shown are outboard motors. Although a particular example having two propulsion devices is shown and described, the concepts of the present disclosure are applicable to marine vessels having any number of propulsion devices. Configurations with less than or more than two marine propulsion devices are contemplated. Parts of this disclosure and claims refer to a "propulsion device"; however, these descriptions are intended to equally apply to arrangements having "one or more propulsion devices". The concepts in the present disclosure are applicable to marine vessels having any type or configuration of propulsion device, such as for example internal combustion engines, electric motors, and/or hybrid systems configured as an inboard drive, outboard drive, inboard/outboard drive, stem drive, and/or the like. The propulsion devices can include any type of propulsor such as propellers, impellers, pod drives and/or the like.

The marine propulsion devices 12*a*, 12*b* are each rotatable in clockwise and counterclockwise directions through a substantially similar range of rotation about respective steering axes 14*a*, 14*b*. Rotation of the marine propulsion devices 12*a*, 12*b* is facilitated by conventional steering actuators 16*a*, 16*b* (see FIG. 3). Steering actuators for rotating marine propulsion devices are well known in the art, examples of which are provided in U.S. Pat. No. 7,467,595, the disclosure of which is hereby incorporated herein by reference in its entirety. Each marine propulsion device 12*a*, 12*b* creates propulsive thrust in both forward and reverse directions to, in turn, maneuver the marine vessel 10, as is conventional. FIG. 1 shows the marine propulsion devices 12*a*, 12*b* operating in forward gear, such that resultant forwardly acting thrust vectors 18*a*, 18*b* on the marine vessel 10 are produced; however, it should be recognized that the propulsion devices 12*a*, 12*b* could also be operated in reverse gear and thus provide oppositely oriented (i.e. reversely acting) thrust vectors on the vessel 10.

As shown in FIG. 1, the propulsion devices 12*a*, 12*b* are aligned in a longitudinal direction L to thereby define thrust vectors 18*a*, 18*b* extending in the longitudinal direction L. The particular orientation shown in FIG. 1 often is employed to achieve a forward or backward movement of the marine vessel 10 in the longitudinal direction L or a rotational movement of the vessel 10 with respect to the longitudinal direction L. Specifically, operation of the propulsion devices 12*a*, 12*b* in forward gear causes the marine vessel 10 to move forwardly in the longitudinal direction L. Conversely, operation of propulsion devices 12*a*, 12*b* in reverse gear causes the marine vessel 10 to move reversely in the longitudinal direction L. Further, operation of one of propulsion devices 12*a*, 12*b* in forward gear and the other in reverse gear causes rotation of the marine vessel 10 about a center of turn 20 with respect to the longitudinal direction L. The center of turn 20 represents an effective center of gravity for the marine vessel 10; however, it will be understood by those having ordinary skill in the art that the location of the center of turn 20 is not, in all cases, the actual center of gravity of the marine vessel 10. That is, center of turn 20 can be located at different locations than the actual center of gravity that would be calculated by analyzing the weight distribution of various components of the marine vessel 10. This concept and related concepts are recognized by those having ordinary skill in the art with reference to the center of turn, instantaneous center of turn in U.S. Pat. No. 6,234,853, and instantaneous center in U.S. Pat. No. 6,994,046, which are hereby incorporated herein by reference in entirety. Various other maneuvering strategies and mechanisms are described in U.S. Pat. Nos. 6,234,853; 7,267,068; and 7,467,595, which are hereby incorporated herein by reference in entirety.

Figure 2:
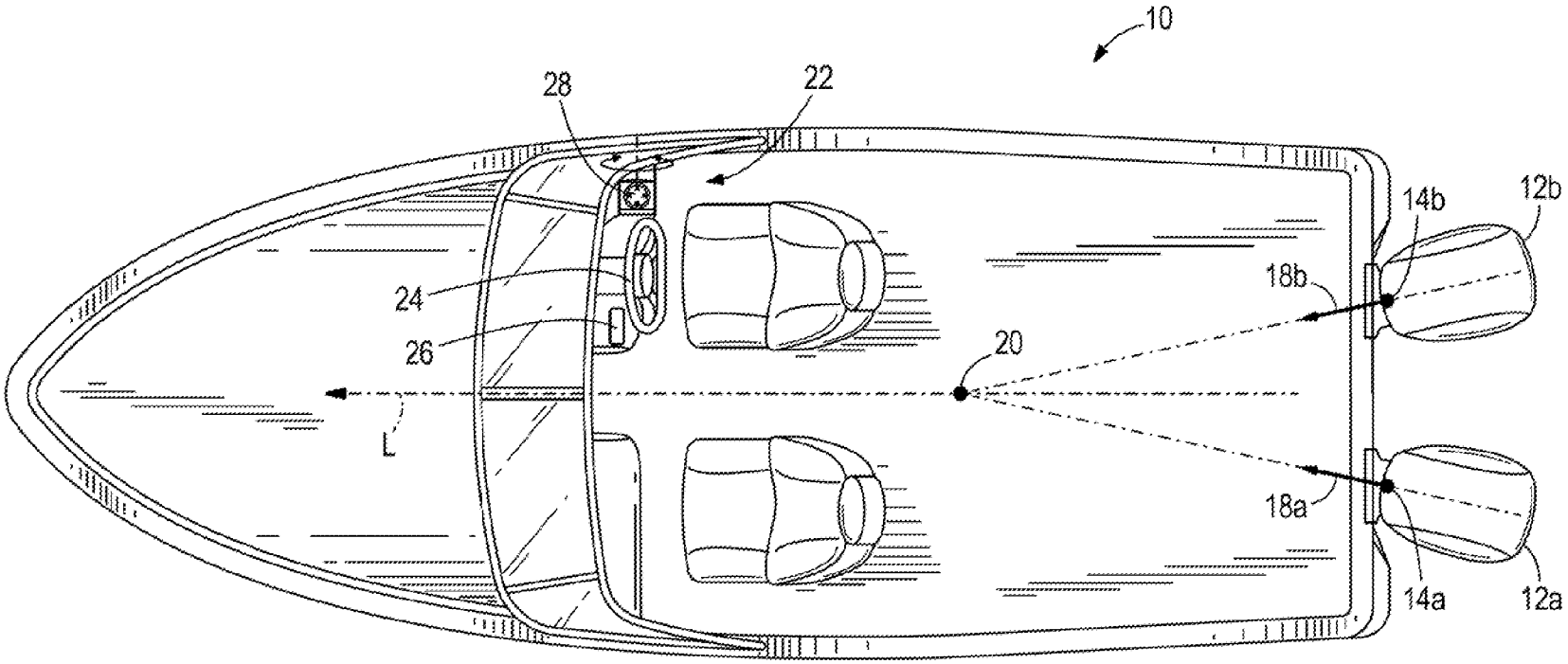
FIG. 2 is a top view of the marine vessel, wherein the marine devices are in an inwardly splayed orientation.

As shown in FIG. 2, the marine propulsion devices 12*a*, 12*b* are rotated out of the aligned position shown in FIG. 1 so that the marine propulsion devices 12*a*, 12*b* and their resultant thrust vectors 18*a*, 18*b* are not aligned in the longitudinal direction L. In the example shown in FIG. 2, the marine propulsion devices 12*a*, 12*b* are splayed inwardly and operated so as to provide thrust vectors 18*a*, 18*b* that are aligned with a common point, which in this example is the center of turn 20. This orientation is commonly utilized to obtain lateral movement of the vessel 10 with respect to the longitudinal direction L. In addition to the example shown in FIG. 2, various other unaligned positions and relative different or equal amounts of thrust of marine propulsion devices 12*a*, 12*b* are possible to achieve one or both of a rotational movement and a movement of the vessel 10 in any direction, including laterally to and along the longitudinal direction L.

The orientation of marine propulsion devices 12*a*, 12*b* shown in FIG. 1 is often employed during a "lever mode" of a control system 30 (see FIG. 3), wherein forward and reverse translations of the vessel 10 with respect to the longitudinal direction L are requested, typically for example to move the vessel through open water. Conventionally, these types of lateral movements are requested via a combination shift/throttle lever that is pivotable about a horizontal axis that is perpendicular to the longitudinal direction L. An example of this type of device is shown in U.S. Pat. No. 6,866,022, which is hereby incorporated herein by reference in entirety. Conversely, the orientation of marine propulsion devices 12*a*, 12*b* shown in FIG. 2 is often employed during a "joystick mode" of a control system 30 of the marine vessel 10, wherein lateral movements of the marine vessel 10 with respect to the longitudinal direction L are requested, typically for example during docking of the vessel 10. These types of lateral movements are requested by an operator via a joystick 100 (see the example described herein below with respect to FIGS. 4-8) that is pivotable in 360-degree motion away from vertical. The respective orientations of marine propulsion devices 12*a*, 12*b* shown in FIGS. 1 and 2 can also be employed during the aforementioned "joystick mode" when yaw of the marine vessel 10 is requested by the joystick 100, such as for example by turning the handle on the joystick, which will be further described herein below.

Figure 3:
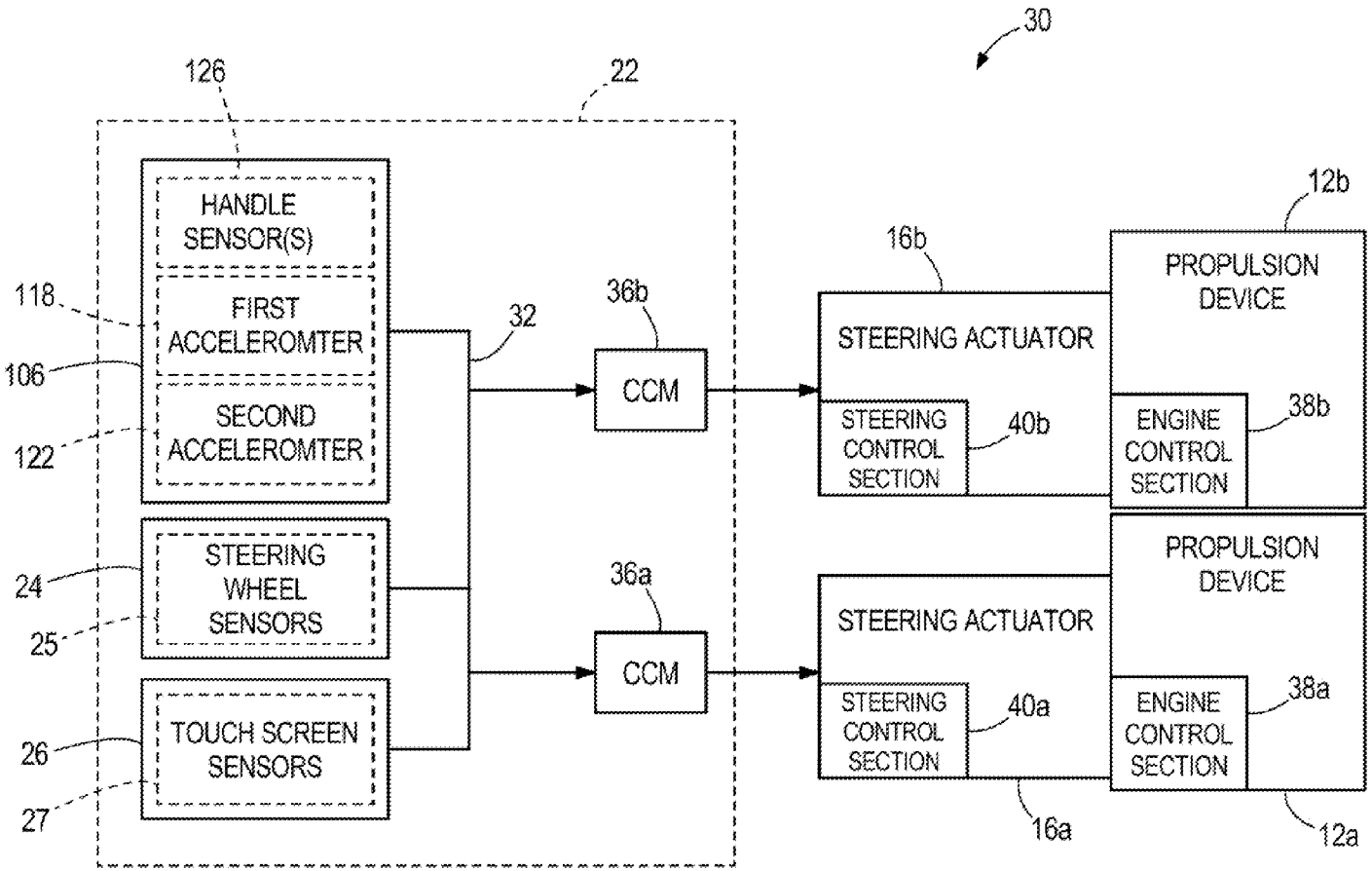
FIG. 3 is a schematic depiction of a control circuit for controlling the propulsion devices.

Referring to FIG. 3, the marine vessel 10 includes a helm 22, where an operator can input commands for maneuvering the marine vessel 10 via one or more input devices. The input devices can include a steering wheel 24, a touch screen 26, and the joystick 100 described further herein below with reference to FIGS. 4-11 for inputting commands to the control system 30. The number and type of input devices can vary from that shown.

The devices 24, 26, 100 communicate with a control circuit 32, which in the example shown includes a control network, as described in the incorporated U.S. Pat. No. 6,273,771. In this example, the devices 24, 26, 100 each have one or more sensors for sensing operator movements of the respective device and communicating same to the control circuit 32. For example, the steering wheel 24 has conventional steering wheel sensors 25. The touch screen 26 has conventional touch screen sensors 27. As discussed further herein below, the joystick 100 has first and second accelerometers 118, 122 and handle sensor(s) 126 for sensing movement. Note that it is not required that the input devices 24, 26, 100 communicate with the control circuit 32 via a control circuit area network. For example, one or more of these items can be connected to the control circuit 32 by hardwire or wireless connection.

The control circuit 32 is programmed to control operation of the marine propulsion devices 12*a*, 12*b* and steering actuators 16*a*, 16*b* associated therewith. The control circuit 32 can have different forms. In the example shown, the control circuit 32 includes a plurality of command controls modules 36*a*, 36*b* located at the helm 22. A command control module 36*a*, 36*b* is provided for each of the port and starboard marine propulsion devices 12*a*, 12*b*. The control circuit 32 also includes engine control sections 38*a*, 38*b* located at and controlling operation of each respective propulsion device 12*a*, 12*b*, and a steering control section 40*a*, 40*b* located at and controlling operation of each respective steering actuator 16*a*, 16*b*. Each control section has a memory and a processor for sending and receiving electronic control signals, for communicating with other parts of the control circuit 32, and for controlling operations of certain components in the system 30 such as the operation and positioning of marine propulsion devices 12*a*, 12*b* and relating steering actuators 16*a*, 16*b*. The control circuit 32 is shown in simplified schematic form and can have any number of sections (including for example one section) and can be located remotely from or at different locations in the marine vessel 10 from that shown. It should be understood that the concepts disclosed in the present disclosure are capable of being implemented with different types of control systems, including systems that acquire global position data and real time positioning data, such as for example global positioning systems, inertial measurement units, and/or the like.

Figure 4:
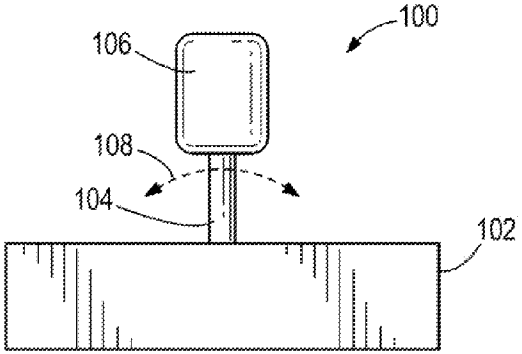
FIGS. 4-6 depict an input device according to the present disclosure.
Figure 5:
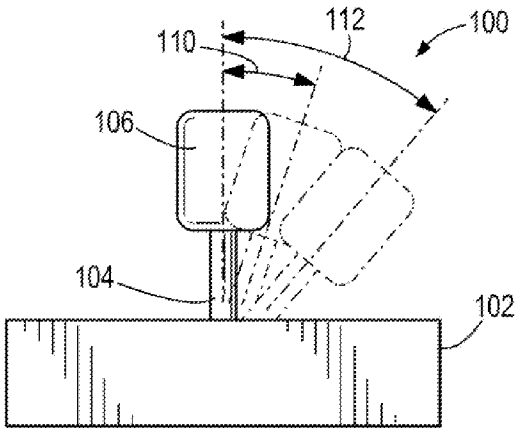
Figure 6:
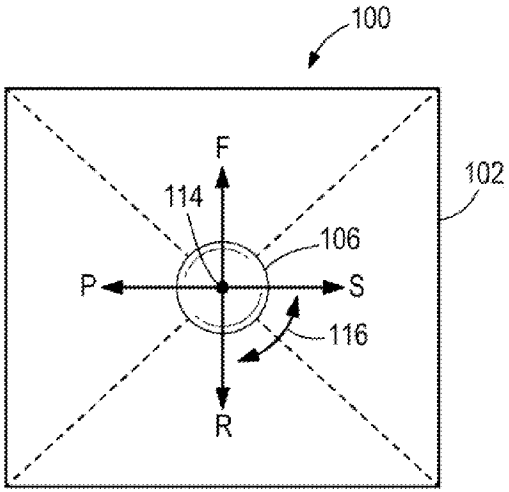

Schematic depictions of a joystick 100 according to the present disclosure is depicted in FIGS. 4-6. The joystick 100 includes a base 102, a shaft 104 extending vertically upwardly relative to the base 102, and a handle 106 located on top of the shaft 104. The shaft 104 is pivotable, as represented by dashed-line arrow 108 in numerous directions relative to the base 102. FIG. 5 illustrates the shaft 104 and handle 106 in three different positions which vary by the magnitude of angular movement. Arrows 110 and 112 show different magnitudes of movement. The amount of movement and direction of movement away from the generally vertical position shown in FIG. 4 represents an analogous magnitude and direction of an actual movement command selected by an operator. FIG. 6 is a top view of the joystick 100 in which the handle 106 is in a central, vertical, or neutral position. The handle 106 can be manually manipulated in a forward F, reverse R, port P or starboard S direction or a combination of these to provide actual movement commands into F, R, P, S directions or any other direction therebetween. In addition, the handle 106 can be rotated about the centerline 114 of the shaft 104 as represented by arrow 116 to request rotational movement or yaw of the marine vessel 10 about the center of turn 20. Clockwise rotation of the handle 106 requests clockwise rotation of the marine vessel 10 about the center of turn 20, whereas counterclockwise rotation of the handle 106 requests counterclockwise rotation of the vessel about the center of turn 20.

Figure 7:
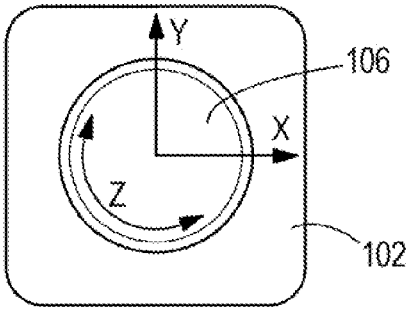
FIG. 7 is a top view of the input device.
Figure 8:
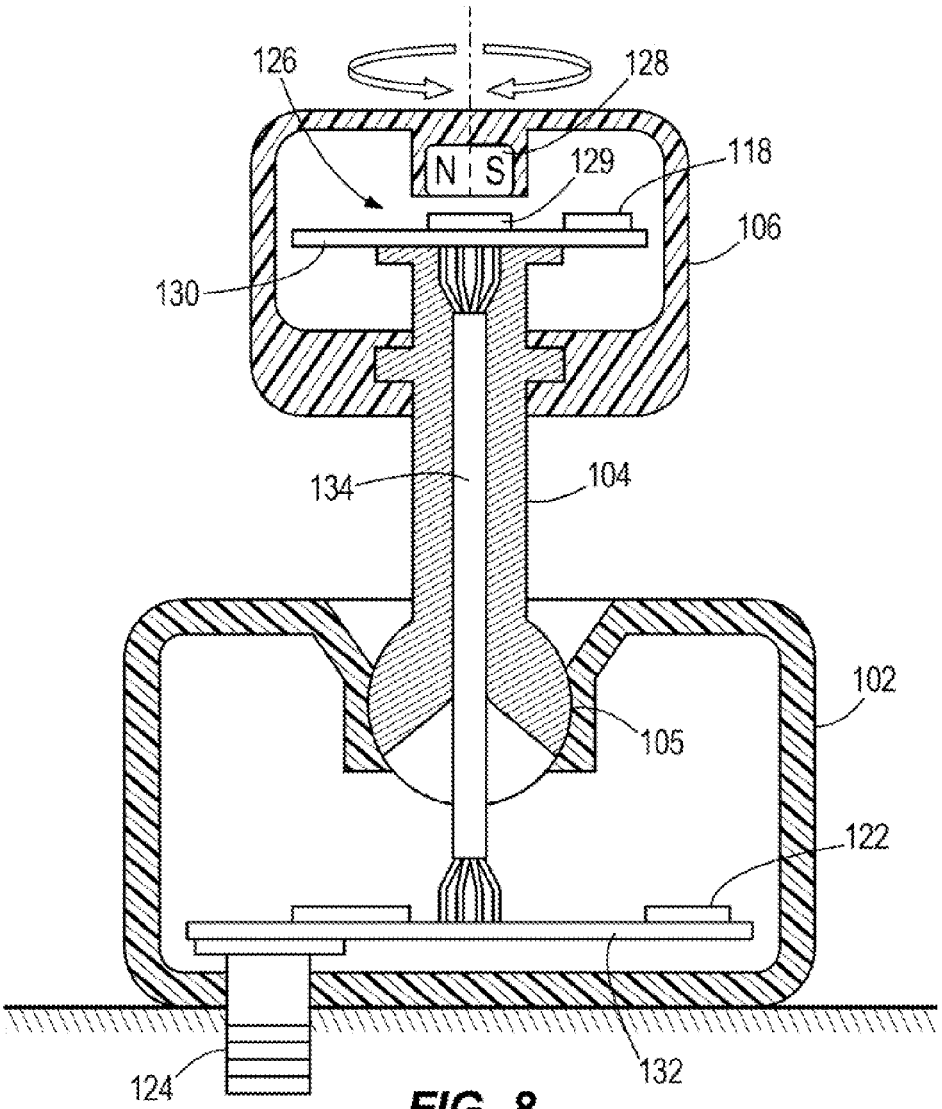
FIG. 8 is a sectional view of the input device.
Figure 9:
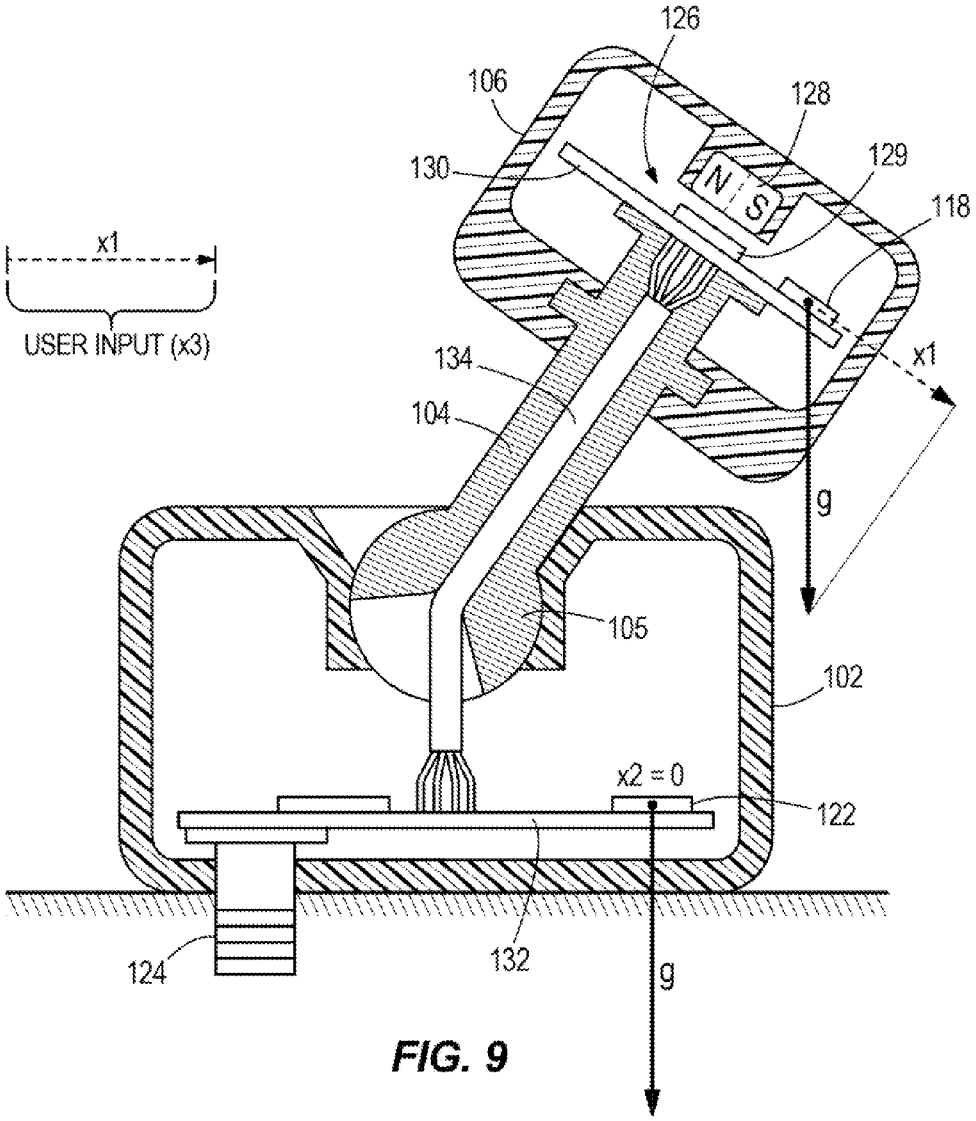
FIG. 9 is a sectional view of the input device having a handle pivoted with respect to a base, wherein the marine vessel is stationary and in a level position.
Figure 10:
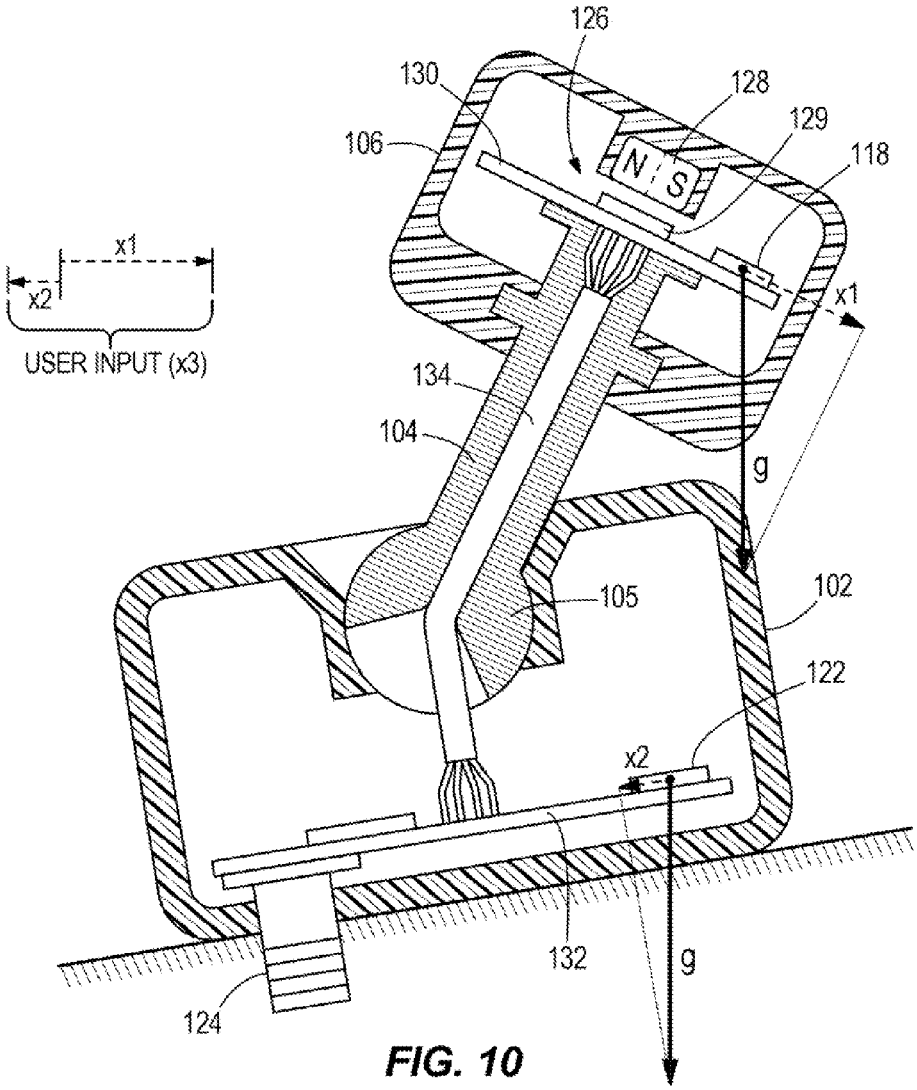
FIG. 10 is a sectional view of the input device having a handle pivoted with respect to a base, wherein the marine vessel is stationary and is not in a level position.
Figure 11:
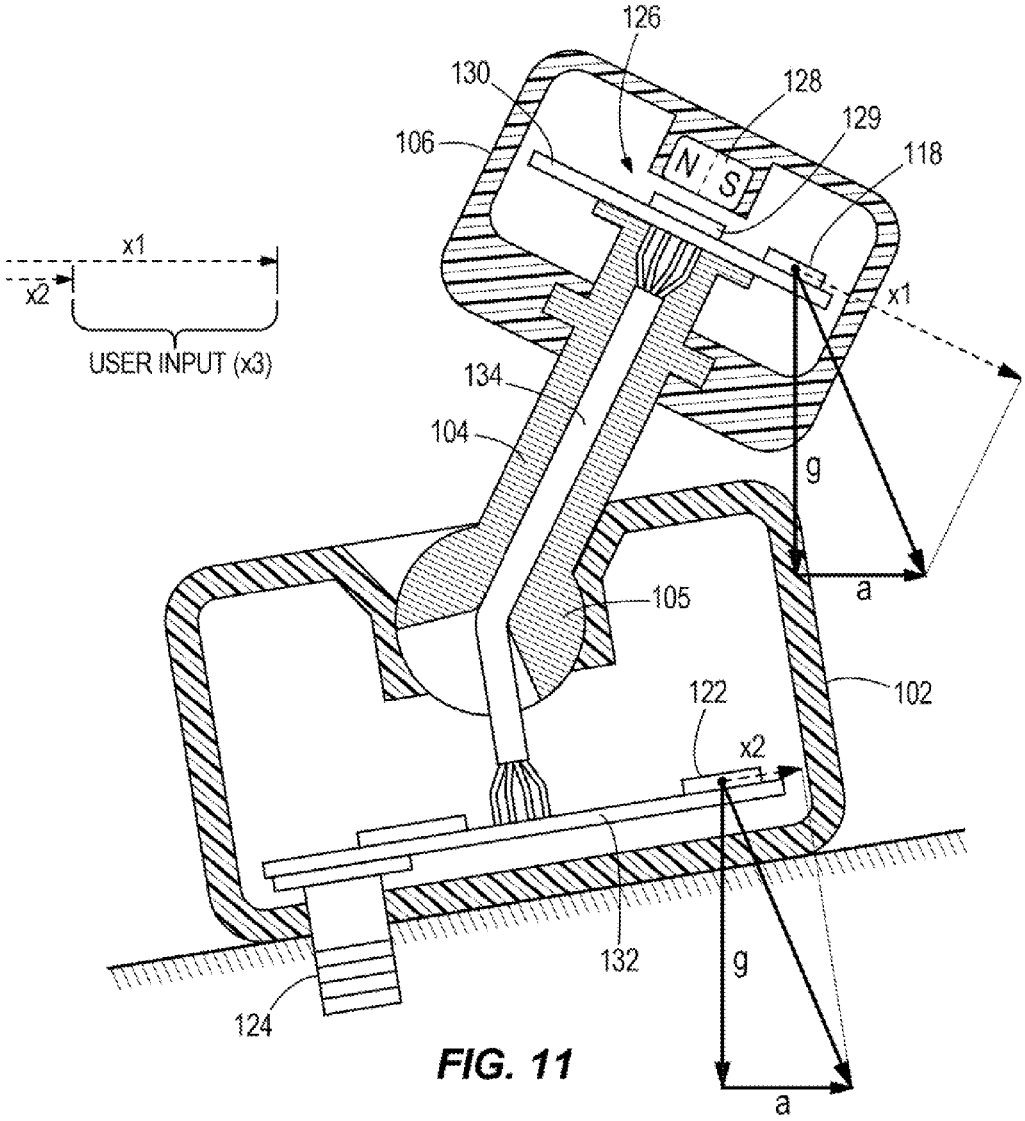
FIG. 11 is a sectional view of the input device having a handle pivoted with respect to a base, wherein the marine vessel is laterally accelerating and is not in a level position.
Figure 12:
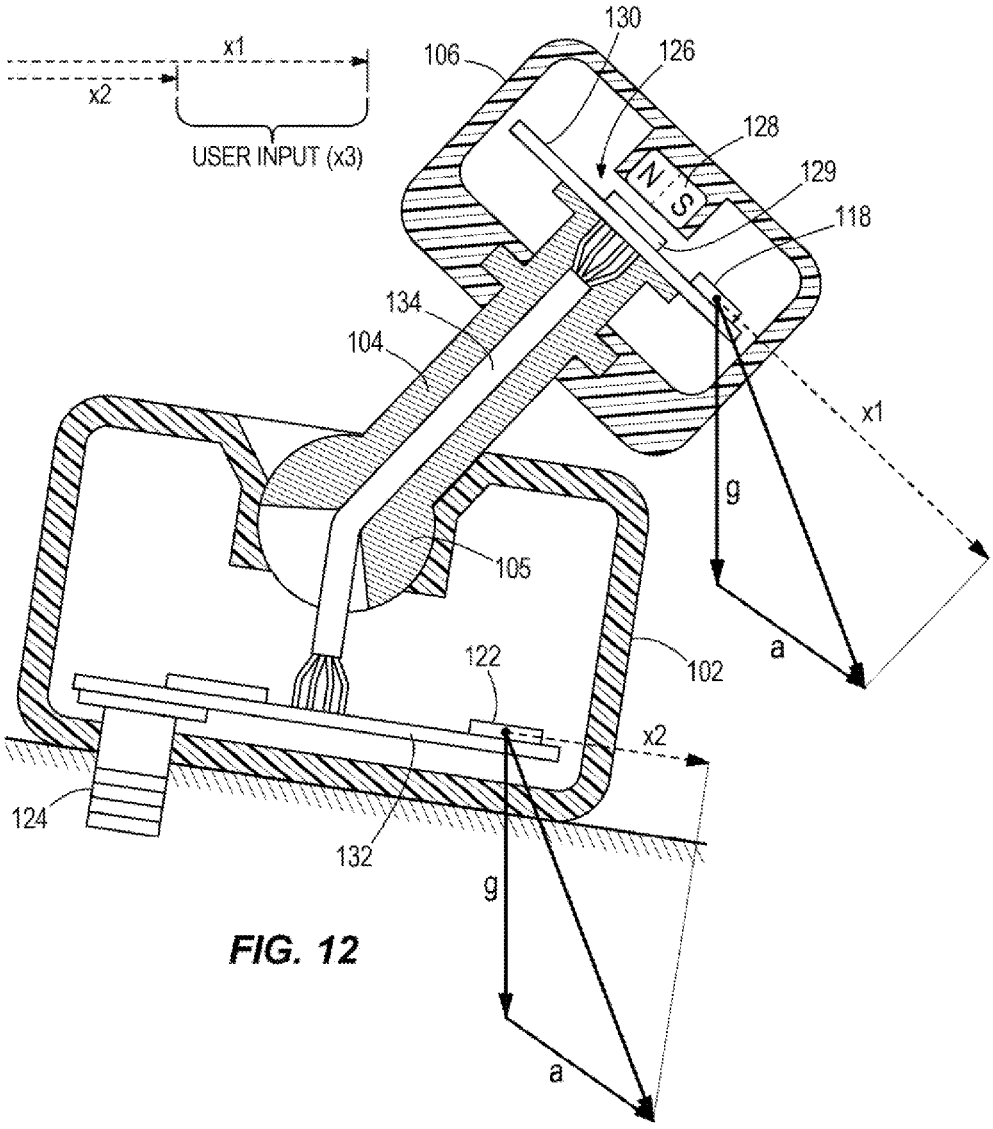
FIG. 12 is a sectional view of the input device having a handle pivoted with respect to a base, wherein the marine vessel is laterally and vertically accelerating and is not in a level position.

FIGS. 7-12 depict the joystick 100 during different operational situations. FIG. 7 depicts a top view of the joystick wherein pivotal movement of the handle 106 is possible with respect to X- and Y-axes and rotational movement of the handle 106 is possible with respect to a Z-axis, as described herein above. FIG. 8 is a schematic sectional view of the joystick 100 wherein the handle 106 is in the central, vertical or neutral position shown in FIGS. 4 and 6. FIG. 9 is a schematic sectional view of the joystick 100 wherein the handle 106 is pivoted with respect to the base 102 (like in FIG. 5), in a direction that is parallel the X-axis, and wherein the marine vessel 10 is stationary and in a level position. FIG. 10 is a schematic sectional view of the joystick 100 wherein the handle 106 is pivoted with respect to a base 102, in a direction that is parallel the X-axis, and wherein the marine vessel 10 is stationary and is not in a level position. FIG. 11 is a schematic sectional view of the joystick 100 wherein the handle 106 is pivoted with respect to a base 102, in a direction that is parallel the X-axis, and wherein the marine vessel 10 is laterally accelerating and is not in a level position. FIG. 12 is a schematic sectional view of the joystick 100 wherein the handle 106 pivoted with respect to a base 102, in a direction that is parallel the X-axis, and wherein the marine vessel 10 is laterally and vertically accelerating and is not in a level position.

Referring to FIG. 8, the shaft 104 of the joystick 100 is pivoted with respect to the base 102 about a pivot 105, which in the example shown is a universal ball joint. Other types of conventional pivots could instead be employed. The joystick 100 has a handle (first) accelerometer 118 coupled to the handle 106 and a base (second) accelerometer 122 coupled to the base 102. Both accelerometers 118, 122 are conventional two-axis accelerometers that can output electrical signals indicating the direction of movement and amount of movement of the respective accelerometer with respect to the mutually perpendicular X- and Y-axes. Such two-axis accelerometers that output direction of movement and amount of movement are known in the art. A suitable two-axis accelerometer for use with the presently disclosed examples is commercially available from Analog Devices Inc., Model No. ADXL210E, which is a two-axis accelerometer on a single monolithic IC chip. This model measures accelerations with a full-scale range of plus or minus 10 g. The outputs of the accelerometers can be analog voltage or digital signals and can have duty cycle outputs (ratio of pulsewidth to period) that are proportional to acceleration. The duty cycle outputs can be directly measured by the control circuit 30 (e.g. in a microprocessor counter that is built into the control circuit 30) to determine the noted amount of acceleration and direction of movement with respect to the X- and Y-axes. In the illustrated example, the handle and base accelerometers 118, 122 are attached to respective printed circuit boards 130, 132, which are electrically communicatively connected together by a wire harness 134. An input/output port 124 is connected to the printed circuit board 132 and electrically receives and communicates the outputs of the accelerometers 118, 122 to the control circuit 32 via a wired or wireless link.

As explained hereinabove, the handle 106 also is rotatable (e.g. about the Z-axis) with respect to the base 102. A rotation sensor device 126 is configured to sense rotation of the handle 106 with respect to the Z-axis. The particular type of rotation sensor arrangement can vary from that shown. In the illustrated example, the sensor device 126 includes a rotary Hall Effect sensor 129 that senses rotation of a magnet 128 that is fixed to the handle 106. This conventional type of sensor is described in the incorporated U.S. Reissue Pat. No. RE39, 032. Electrical outputs of the sensor device 126 are provided to the port 124 via, for example, printed circuit boards 130, 132 and wired link/harness 134.

In the example shown in FIG. 8, the handle accelerometer 118 is located proximate to the base accelerometer 122 so that movements of the joystick 100 other than pivoting movements of the handle 106 with respect to the base 102, produce essentially the same outputs from the handle accelerometer 118 and base accelerometer 122. That is, the handle and base accelerometers 118, 122 are equally affected by such movements. For example, everything else being equal, when the marine vessel 110 is moved by waves, the accelerometers 118, 122 each output signals that represent acceleration of the vessel 10 in the vertical direction, i.e. with respect to the Z-axis. Similarly, when the marine vessel 10 is moved in the lateral and/or longitudinal directions, by wind, waves, operation of the devices 12*a*, 12*b*, etc., the accelerometers 118, 122 each output signals that represent accelerations of the vessel 10 in the lateral and/or longitudinal directions, i.e. with respect to the X- and Y-axes. Also, both the handle accelerometer and base accelerometer 118, 122 are constantly subjected to the force of gravity (1 g) and therefore each output signals that represent 1 g of acceleration in the vertical direction, i.e. with respect to the Z-axis. Thus, when the control circuit 32 compares the outputs of the first and second accelerometers 118, 112, outputs based upon movements of the joystick 100 other than pivoting movements of the handle 106 with respect to the base mathematically cancel, leaving a remainder that represents net movement of the handle 106 with respect to the base 102. FIGS. 9-12 provide examples of this method of operation and the programming calculation associated therewith.

FIG. 9 depicts a situation where the marine vessel 10 is level and stationary, and an operator pivots the handle 106 with respect to the base 102 to request movement of the marine vessel 10 along (i.e. parallel to) the X-axis. As the handle 106 is moved, the handle accelerometer 118 provides an output resulting from a combination of the force of gravity (here designated as 1 g) and acceleration (x1) of the handle 106 with respect to the X-axis. Simultaneously, the base accelerometer 122 provides an output resulting from a combination of the force of gravity (1 g) and zero (x2=0) acceleration of the base 102 respect to the X- and Y-axes (that is, the marine vessel is level and is not accelerating and therefore x2=0). These outputs are both provided to the control circuit 32 via the port 124. As explained herein above, the control circuit 32 is programmed to compare the outputs of the accelerometers 118, 122 and thereby calculate a net result (i.e. calculate the difference between the respective outputs). In the example of FIG. 9, the net acceleration of the handle 106 and base 102 resulting from gravity is zero (0). The remainder is the net amount of movement of the handle 106 with respect to the base 102 along the X-axis (i.e. x1−x2=x3). This resultant is illustrated in FIG. 9 as a vector having a magnitude and a direction that respectively represent an amount of movement of the handle 106 with respect to the base and direction of movement of the handle 106 with respect to the base 102. Based upon this calculation, the control circuit 32 is then programmed to output control signals to the system 30, as described herein above, to operate the marine propulsion devices 12*a*, 12*b* and cause speed and direction of movement of the marine vessel 10 that is commensurate with the net amount of movement (x3) of the handle 106 and net direction of movement (along the X-axis) of the handle 106 with respect to the base 102.

FIG. 10 depicts a situation wherein the marine vessel 10 is stationary, but is not in a level position. The handle 106 is pivoted with respect to the base 102 along (i.e. parallel to) the X-axis. Here, the fact that the marine vessel 10 is not level equally affects the outputs of both the handle accelerometer 118 and the base accelerometer 122. As the handle 106 is moved, the handle accelerometer 118 provides an output that results from a combination of the force of gravity (here designated as 1 g) and acceleration (x1) of the handle 106, both with respect to the non-level marine vessel 10. Simultaneously, the base accelerometer 122 provides an output that results from the force of gravity (1 g), which also causes acceleration (x2) with respect to the X-axis in view of the non-level marine vessel 10. Both outputs are provided to the control circuit 32 via the port 124. As explained herein above, the control circuit 32 is programmed to compare the outputs of the accelerometers 118, 122 and calculate a net result (i.e. calculate the difference between the respective outputs). In the example of FIG. 10, the remainder is the net amount of movement of the handle 106 with respect to the base 102 along the X-axis (i.e. x1−x2=x3). This resultant is illustrated in FIG. 10 as a vector having a magnitude and a direction that respectively represent an amount of movement of the handle 106 with respect to the base 102 and direction of movement of the handle 106 with respect to the base 102. Based upon this calculation, the control circuit 32 is then programmed to output control signals to the system 30, as described hereinabove, to operate the marine propulsion devices 12*a*, 12*b* and cause movement of the marine vessel 10 that is commensurate with the net amount of movement (x3) of the handle 106 and net direction of movement of the handle 106 (along the X-axis) with respect to the base 102.

FIG. 11 depicts a situation wherein the marine vessel 10 is laterally accelerating and is not in a level position. The handle 106 is pivoted with respect to the base 102 along the X-axis. Here, the fact that the marine vessel 10 is laterally accelerating and not level equally affects the outputs of both the handle accelerometer 118 and the base accelerometer 122. As the handle 106 is moved, the handle accelerometer 118 provides an output that results from the force of gravity (here designated as 1 g), the lateral acceleration of the marine vessel 10 (here "a") and movement (x1) of the handle 106, all with respect to the non-level marine vessel 10. Simultaneously, the base accelerometer 122 provides an output that results from the force of gravity (1 g) which causes acceleration (x2) with respect to the X-axis in view of the non-level marine vessel 10 and the lateral acceleration ("a") of the marine vessel 10. Both outputs are provided to the control circuit 32 via the port 124. As explained herein above, the control circuit 32 is programmed to compare the outputs of the accelerometers 118, 122 and calculate a net result (i.e. calculate the difference between the respective outputs). In the example of FIG. 11, the remainder is the net amount of movement of the handle 106 with respect to the base 102 along the X-axis (i.e. x1−x2=x3). This resultant is illustrated in FIG. 11 as a vector having a magnitude and a direction that respectively represent an amount of movement of the handle 106 with respect to the base and direction of movement of the handle 106 with respect to the base 102. Based upon this calculation, the control circuit 32 is then programmed to output control signals to the system 30, as described hereinabove, to operate the marine propulsion devices 12*a*, 12*b* and cause movement of the marine vessel 10 that is commensurate with the net amount of movement (x3) of the handle 106 and net direction of movement of the handle 106 (along the X-axis) with respect to the base 102.

FIG. 12 depicts a situation wherein the marine vessel 10 is laterally and vertically accelerating, and is not in a level position. The handle 106 is pivoted with respect to the base 102 along (i.e. parallel to) the X-axis. Here, the fact that the marine vessel 10 is laterally and vertically accelerating and not level equally affects the outputs of both the handle accelerometer 118 and the base accelerometer 122. As the handle 106 is moved, the handle accelerometer 118 provides an output that results from the force of gravity (here designated as 1 g), the lateral and vertical acceleration of the marine vessel 10 (here "a") and movement (x1) of the handle 106, all with respect to the non-level marine vessel 10. Simultaneously, the base accelerometer 122 provides an output that results from the force of gravity (1 g) with respect to the non-level marine vessel 10 and the lateral (x2) and vertical (a) acceleration of the marine vessel 10. Both outputs are provided to the control circuit 32 via the port 124. As explained herein above, the control circuit 32 is programmed to compare the outputs of the accelerometers 118, 122 and calculate a net result (i.e. calculate the difference between the respective outputs). In the example of FIG. 12, the remainder is the net amount of movement of the handle 106 with respect to the base 102 along the X-axis (i.e. x1−x2=x3). This resultant is illustrated in FIG. 12 as a vector (x3) having a magnitude and a direction that respectively represent an amount of movement of the handle 106 with respect to the base and direction of movement of the handle 106 with respect to the base 102. Based upon this calculation, the control circuit 32 is then programmed to output control signals to the system 30, as described hereinabove, to operate the marine propulsion devices 12*a*, 12*b* and cause movement of the marine vessel 10 that is commensurate with the net amount of movement (x3) of the handle 106 and net direction of movement of the handle 106 (along the X-axis) with respect to the base 102.

The examples shown in FIGS. 8-12 each depict pivoting movement of the handle 106 with respect to the base 102 in a direction that is parallel to the X-axis. It will also be understood by those having ordinary skill in the art that the above noted calculations are equally applicable to pivoting movements of the handle 106 in directions other than parallel to the X-axis. The vector analysis described herein above can thus be conducted for movements of the base with respect to the X- and Y-axes that are in different directions than movements of the handle 106 with respect to the X- and Y-axes, wherein a resultant vector is calculated by the control circuit according to the methods described herein above.

It can be seen from the above described examples that the present disclosure provides a system for operator control of a marine vessel. The system includes an input device 100 having a base 102 and a handle 106 that is pivotable with respect to the base 102. A first accelerometer 118 is coupled to the handle 106 and has an output that indicates an amount of acceleration of the handle 106 in a direction of movement of the handle 106. A second accelerometer 122 is coupled to the base 102 and has an output that indicates an amount of acceleration of the base 102 and a direction of movement of the base 102. A control circuit 32 compares the outputs of the first accelerometer 118 and second accelerometer 122 to calculate an amount of movement of the handle 106 with respect to the base 102 and a direction of movement of the handle 106 with respect to the base 102. The control circuit 32 outputs control signals to the system to cause movement of the marine vessel 10 that are commensurate with the amount of movement of the handle 106 with respect to the base 102. The first accelerometer 118 is located proximate to the second accelerometer 122 so that movements of the input device 100 other than pivoting movements of the handle 106 with respect to the base 102 have essentially the same affect on the first and second accelerometers 118, 122. Based upon the outputs of the first and second accelerometers 118, 122, the control circuit 32 calculates a net resultant vector having a magnitude and a direction that represent the amount of movement of the handle 106 with respect to the base 102 and direction of movement of the handle 106 with respect to the base 102. The base 102 is fixed with respect to the marine vessel 10 such that movements of the marine vessel 10 equally impact the first and second accelerometers 118, 122. The first and second accelerometers 118, 122 are two axis accelerometers that output direction of movement with respect to mutually perpendicular X- and Y-axes. The handle 106 can be rotatable with respect to the base 102 about the Z-axis. A sensor device 126 outputs a signal to the control circuit 32 representing an amount of rotation of the handle 106 with respect to the base 102.

In use, the system affords a method of operator control of movement of the marine vessel 10. According to a first step, the handle 106 is pivoted with respect to the base 102, which is fixed to the marine vessel 10. According to a second step, an amount of acceleration of the base 102 and a direction of movement of the base 102 with respect to the marine vessel 10 is outputted to a control circuit 32. According to a third step, an amount of acceleration of the handle 106 and direction of movement of the handle 106 is outputted to the control circuit 32. According to a fourth step, with the control circuit 32, an amount of movement of the handle 106 with respect to the base 102 and a direction of movement of the handle 106 with respect to the base 102 is calculated based upon the outputs of the first and second accelerometers 118, 122. The method can further include calculating, with the control circuit 32, a net resultant vector having a magnitude and a direction that represent amount of movement of the handle 106 with respect to the base 102 and direction of movement of the handle 106 with respect to the base 102. Further, the method can include outputting to the system control signals that cause movement of the marine vessel 10 commensurate with the amount of movement of the handle 106 and direction of movement of the handle 106, as calculated by the control circuit 32.

What is claimed is:

1. A system for operator control of a marine vessel, the system comprising:

a base;

a handle that is pivotable with respect to the base;

a first accelerometer coupled to the handle, the first accelerometer having an output that indicates an amount of an acceleration of the handle and a direction of movement of the handle;

a second accelerometer coupled to the base, the second accelerometer having an output that indicates an amount of acceleration of the base and a direction of movement of the base; and a control circuit that compares the outputs of the first accelerometer and the second accelerometer to calculate an amount of movement of the handle with respect to the base and a direction of movement of the handle with respect to the base.

2. The system according to claim 1, wherein the control circuit outputs control signals to the system that cause movements of the marine vessel that are commensurate with the amount of the movement of the handle with respect to the base and the direction of movement of the handle with respect to the base.

3. The system according to claim 1, wherein the first accelerometer is located proximate to the second accelerometer so that movements of the input device other than pivoting movements of the handle with respect to the base have essentially the same effect on the first and second accelerometers.

4. The system according to claim 1, wherein based on the outputs of the first and second accelerometers, the control circuit calculates a net resultant vector having a magnitude and a direction that respectively represent the amount of movement of the handle with respect to the base and the direction of movement of the handle with respect to the base.

5. The system according to claim 1, wherein base is fixed to the marine vessel, and wherein movements of the marine vessel have essentially the same effect on the first and second accelerometers.

6. The system according to claim 1, wherein the first accelerometer is a two axis accelerometer that outputs direction of movement with respect to mutually perpendicular X- and Y-axes and wherein the second accelerometer is a two-axis accelerometer that outputs direction of movement of the base with respect to said mutually perpendicular X- and Y-axes.

7. The system according to claim 6, wherein the handle is rotatable with respect to the base about a Z-axis that is perpendicular to the X-axis and perpendicular to the Y-axis, and further comprising a sensor that senses rotation of the handle with respect to the base and outputs a signal to the control circuit representing an amount of rotation of the handle with respect to the base.

8. The system according to claim 7, wherein the sensor comprises a rotary hall-effect sensor.

9. A marine vessel, comprising:

a helm;

a base that is fixed to the helm;

a handle that is pivotable with respect to the base;

a first accelerometer coupled to the handle, the first accelerometer having an output that indicates an amount of an acceleration of the handle and a direction of movement of the handle;

a second accelerometer coupled to the base, the second accelerometer having an output that indicates an amount of acceleration of the base and a direction of movement of the base; and a control circuit that compares the outputs of the first accelerometer and the second accelerometer to calculate an amount of movement of the handle with respect to the base and a direction of movement of the handle with respect to the base.

10. The marine vessel according to claim 9, wherein the control circuit outputs control signals to the system that cause movements of the marine vessel that are commensurate with the amount of the movement of the handle with respect to the base and the direction of movement of the handle with respect to the base.

11. The marine vessel according to claim 9, wherein the first accelerometer is located proximate to the second accelerometer so that movements of the input device other than pivoting movements of the handle with respect to the base have essentially the same effect on the first and second accelerometers.

12. The marine vessel according to claim 9, wherein based on the outputs of the first and second accelerometers, the control circuit calculates a net resultant vector having a magnitude and a direction that respectively represent the amount of movement of the handle with respect to the base and the direction of movement of the handle with respect to the base.

13. The marine vessel according to claim 9, wherein movements of the marine vessel have essentially the same effect on the first and second accelerometers.

14. The marine vessel according to claim 9, wherein the first accelerometer is a two axis accelerometer that outputs directions of movement with respect to mutually perpendicular X- and Y-axes and wherein the second accelerometer is a two-axis accelerometer that outputs directions of movement with respect to said mutually perpendicular X- and Y-axes.

15. The marine vessel according to claim 14, wherein the handle is rotatable with respect to the base about a Z-axis that is perpendicular to the X-axis and perpendicular to the Y-axis, and further comprising a sensor that senses rotation of the handle with respect to the base and outputs to the control circuit a signal representing an amount of rotation of the handle with respect to the base.

16. The marine vessel according to claim 15, wherein the sensor comprises a rotary hall-effect sensor.

17. A method of operator control of movement of a marine vessel, the method comprising:

pivoting a handle with respect to a base that is fixed to the marine vessel;

outputting an amount of acceleration of the base and a direction of movement of the base to a control circuit;

outputting an amount of an acceleration of the handle and a direction of movement of the handle to the control circuit; and calculating, with the control circuit, an amount of movement of the handle with respect to the base and a direction of movement of the handle with respect to the base based upon the outputs of the first accelerometer and the second accelerometer.

18. The method according to claim 17, further comprising calculating, with the control circuit, a net resultant vector having a magnitude and a direction that respectively represent the amount of movement of the handle with respect to the base and the direction of movement of the handle with respect to the base.

19. The method according to claim 17, further comprising outputting to the system control signals that cause movements of the marine vessel that are commensurate with the amount of the movement of the handle and the direction of movement of the handle, as calculated by the control circuit.

20. The method according to claim 17, further comprising sensing rotation of the handle with respect to the base, and outputting to the control system control signals that cause rotation of the marine vessel that is commensurate with the rotation of the handle.

* * * * *